US005108218A

United States Patent [19]

Wyckoff

[11] Patent Number: 5,108,218

[45] Date of Patent: Apr. 28, 1992

[54] ROADWAY AND SIMILAR MARKER STRIP AND METHOD OF FORMING SAME

[75] Inventor: Charles W. Wyckoff, Needham, Mass.

[73] Assignee: Brite-Line Industries, Bedford, Mass.

[21] Appl. No.: 587,409

[22] Filed: Sep. 25, 1990

[51] Int. Cl.[5] ..... E01F 9/06

[52] U.S. Cl. ..... 404/14; 404/11

[58] Field of Search ..... 404/14, 15, 16, 11

[56] References Cited

U.S. PATENT DOCUMENTS

| | | | |
|---|---|---|---|
| 2,232,023 | 2/1941 | Flocks | 94/1.5 |
| 2,268,538 | 12/1941 | Rodli et al. | 94/1.5 |
| 3,399,607 | 10/1966 | Eigenmann | 94/1.5 |
| 3,587,415 | 6/1971 | Eigenman | 94/1.5 |
| 3,920,346 | 11/1975 | Wyckoff | 404/14 |
| 4,040,760 | 8/1977 | Wyckoff | 404/14 |
| 4,069,787 | 1/1978 | Wyckoff | 116/63 |
| 4,117,192 | 9/1978 | Jorgensen | 428/337 |
| 4,236,788 | 12/1980 | Wyckoff | 350/97 |
| 4,248,932 | 2/1981 | Tung et la. | 428/325 |
| 4,282,281 | 8/1981 | Ethen | 428/149 |
| 4,388,359 | 6/1983 | Ethen et al. | 428/143 |
| 4,490,432 | 12/1984 | Jordan | 428/220 |
| 4,681,401 | 7/1987 | Wyckoff | 350/105 |

*Primary Examiner*—Ramon S. Britts
*Assistant Examiner*—Nancy P. Connolly
*Attorney, Agent, or Firm*—Rines and Rines; Shapiro and Shapiro

[57] ABSTRACT

A flexible longitudinally extending roadway marker strip of flexible plastic rubber-like sheet material (produced by a preferred method of fabrication) comprises a cross-linked or vulcanized upper layer having longitudinally extending therealong successive sets of successively spaced protuberances, ridges or ridge segments deformed therein and extending transversely of the strip. Projecting retroreflective bead coatings are adhered to at least the forward and rearward surfaces of the protuberances, ridges or ridge segments, and flat unbeaded daylight-bright or colored-appearance segments are disposed intermediate the successive sets and have a dimension in the longitudinal direction of the strip greater than that of the individual projections, ridges or ridge segments and the spaces therebetween in each set.

10 Claims, 1 Drawing Sheet

ROADWAY AND SIMILAR MARKER STRIP AND METHOD OF FORMING SAME

Figure 1:
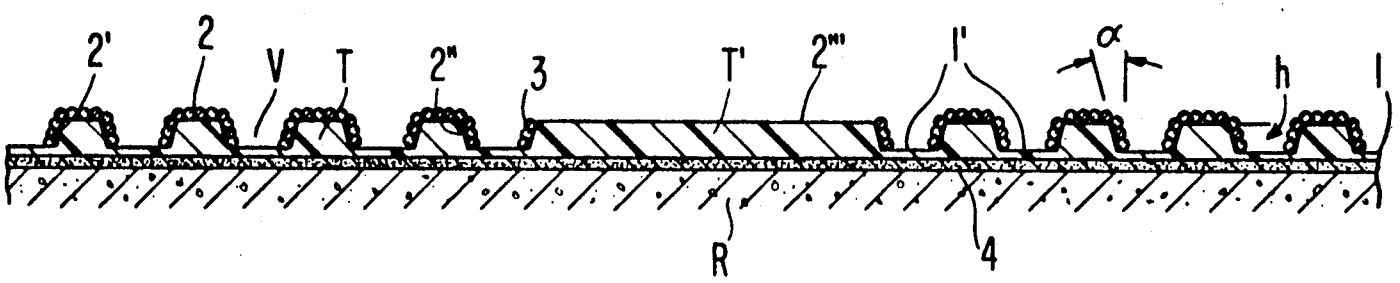

The present invention relates to marker strips and the like for distinctive marking in the direction of travel on motoring highway surfaces, airports and other surfaces, and methods of fabricating the same; being more particularly directed to marker strips of thin flexible plastic adhered to the traveling or other surfaces and employing successively spaced wedges or protuberances provided sometimes with retroreflective materials and other times with only diffusely reflecting surfaces and with improved appearance during daylight hours and at night with high ambient overhead lighting as well as automobile headlamp illumination, even during rainstorms.

BACKGROUND

In my earlier U.S. Pat. No. 4,681,401, an effective improved thin surface marking strip for adhering to a road surface or the like is disclosed embodying novel somewhat flattened, saw-tooth wedges provided with retroreflective material and of preferably substantially trapezoidal shape in longitudinal vertical section with rather critical separations between the wedges relative to height and width of the wedges to obviate shadowing effects, as in sunlight, in order to provide improved daylight observation and to increase effectiveness and life, particularly under conditions of rain-covered surfaces. Earlier art dealing with this type of technology is also disclosed in U.S. Pat. Nos. 4,236,788; 4,069,787; 4,040,760; 3,920,346; 3,587,415; and 3,399,607; 2,268,538 and 2,232,023.

While the marker strips of my said earlier patent and those in copending applications bearing Ser. Nos. 283,192, filed Dec. 12, 1988, now U.S. Pat. No. 4,969,713, issued Nov. 13, 1990 and 309,312 filed Feb. 10, 1989, and of common assignee herewith, have been particularly promising, certain difficulties have been encountered under more strenuous conditions of daylight use during low sun angles and at night with high levels of overhead ambient lighting, with regard to preventing the obscuring of the strips by the shadows cast under such lighting conditions. In addition, some of the earlier marker strips proved very complex to manufacture on a practical basis and did not, in practice, always provide sufficiently brilliant long range visibility by automobile headlamps at night, especially in the rain.

OBJECTS OF INVENTION

An object of the invention, accordingly, is to provide a new and improved marker of the character disclosed that obviates these problems, and a novel practical technique for forming the same.

Other and further objects will be explained hereinafter and are more particularly delineated in the appended claims.

SUMMARY

In summary, however, from one of its aspects, the invention provides for use with a roadway or other surfaces and the like, a direction indicating longitudinally extending surface marker strip comprising an adhesive layer for adhering said marker to the roadway or other surface, a bottom rubber-like non-memory material adjacent the adhesive layer and deformable with cold flow properties for assisting in adherence to said roadway, an upper crosslinkable portion bearing wedges or protuberances, for example, as disclosed in my said copending application, Ser. No. 309, 312, and sometimes containing, at least on the near vertical faces of the protuberances, retroreflective material, while at other times, having only diffusely reflecting surfaces. In accordance with the invention, selected regions of very extensive surfaces (in the longitudinal direction of the strip) between the reflecting protuberances are only diffusely reflecting.

The much larger area provided by these extensive surfaces between series or groups of smaller wedges or protuberances (smaller as measured longitudinally) has been found diffusely to reflect skylight or overhead ambient light without the interruption of shadows sometimes present in the smaller wedges. These selected regions are clearly visible and readily distinguishable from the road surface. Furthermore, by selecting a sufficiently short span of the individual wedges or protuberances between the extensive flat regions of diffuse light reflecting properties, the visual appearance will be a continuous line in daylight, overhead ambient light at night, and/or retroreflection by automobile headlamps, even at night in the rain.

DRAWINGS

Figure 2:
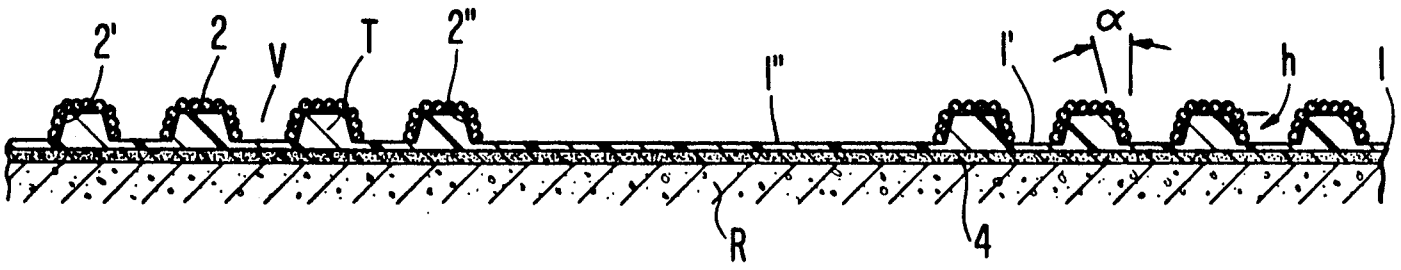

The invention will now be described with reference to the accompanying drawings, FIG. 1 of which is a longitudinal sectional view of a preferred embodiment of the invention; and FIG. 2 is a longitudinal sectional view of another embodiment of the invention.

DESCRIPTION

Referring to FIG. 1, a thin plastic rubber-like elongated longitudinally extending road marker strip 1 is shown adhered by a bottom adhesive layer 4 to a roadway or other surface R. Suitable materials are described in my said earlier patents and applications and are hereinafter more fully discussed.

If the thin plastic elongated road marker strip is comprised of cured materials such as polyurethane, PVC, polycarbonate, epoxy or vulcanized rubber and the like, a deformable mastic adhesive 4 must be used to secure the marker to the road. Such deformable adhesive material, exhibiting cold flow properties, is necessary to absorb the shock energy of vehicular tire impacts, as otherwise a pumping action will result from a constant compression and relaxation cycle as vehicular traffic impacts the marker. This action causes water-bearing dirt to be pumped in and out between the road surface and the marker. The water flows freely, but the dirt is trapped by the adhesive and in time causes the adhesive to lose its ability to adhere to the road surface. If, on the other hand, the marker strip is comprised of uncured or deformable materials such as described in U.S. Pat. Nos. 4,117,192; 4,248,932; 4,282,281; 4,388,359; and 4,490,432, along with my said copending applications, before-referenced, the pumping action previously described will not be a problem and almost any adhesive may be used for the purpose of adhering the marker strip to the road surface.

As previously described, the somewhat flattened saw-tooth wedge construction is illustrated in the drawings in the form of substantially trapezoidal (in longitudinal section) wedge projections T having a flat top surface 2 and bounded by upwardly and downwardly inclining front and rear wedge or ridge surfaces 2' and 2", all extending transversely across strip 1, and all preferably integrally formed from the plastic rubber-like material of the strip 1, with the wedges thus intermittently deformed upward of the strip. If desired, the transversely extending wedges may be transversely interrupted into a plurality of wedge segments as described in my copending application Ser. No. 283,192, filed Dec. 12, 1988, now U.S. Pat. No. 4,969,713, issued Nov. 13, 1990.

A preferred range of acute angles $\alpha$ of inclination (or downward slope) enables proper operation in use as hereinafter discussed. At least the upwardly and downwardly inclined surfaces 2' and 2" may carry a retroreflective layer of optical material such as glass beads, or they may be diffusely reflecting surfaces. Similarly, the surfaces 3 of the later-described segments T' may be so treated.

With this construction, instead of observing an apparent extension of the top of one wedge face continuously merging with next longitudinally spaced succeeding wedge face, and so on, as described in my earlier mentioned patents, there is an interruption in the apparent merging wedge faces by the extent, in the longitudinal strip direction, of the top surfaces 2 of the successive trapezoidal wedges T. Considering daylight operation, including heading into the sun, when this diffusely reflecting flat top surface 2 has the same apparent area as that observable portion of the wedge face which is in shadow in the valleys V therebetween at 1', it has been found that the visual effect of the sun shadow becomes sufficiently reduced to permit the marker 1 to be visually distinguished from the road surface R. Increasing the area would provide even better daylight contrast between the marker and the road surface, but the apparent brightness of night time retroreflection from automobile headlamps would diminish.

It has now been discovered, however, that this apparent night-time brightness would not be diminished appreciably if, periodically, a wedge top surface 2''' is made considerably more extensive in the longitudinal direction. These longer surfaces of wedges T' provide the visual contrast needed for daylight operation and overhead ambient illumination at night, while the near vertical faces 2' and 2" of the smaller flat top wedges T provide the retroreflection means for night-time automobile headlamps.

As shown in FIG. 1, therefore, there is provided, in accordance with the present invention, intermediate periodic wedges T', the top surfaces 2''' of which provide only diffuse light reflection between successive sets or groups of the smaller wedges T. The top surfaces of the wedges T may be provided with retroreflecting beads or similar means, as shown, or may also only diffusely reflect light.

Referring now to FIG. 2, another embodiment of the same principle is illustrated in which the diffusely reflecting intermediate extensive surface between sets of wedges, ridges or ridge segments T is not a protuberance but is a longitudinally extensive valley floor 1" between the sets of protuberances or wedges T.

It has been found that the condition for producing adequate scattered light to permit the marker to be readily visually distinguished from the road surface under certain daylight or night overhead ambient light conditions is fulfilled when the intermediate surfaces 2''' or 1" are at least ten times and preferably twenty to forty times more extensive, in the longitudinal direction, than the normal wedge top surface 2 and/or the space V therebetween. The number of regularly spaced normal wedges T does not appear to be critical. Satisfactory results were obtained with intervals ranging from sets or groups of ten to one hundred or more normal wedges between the intermediate wedge surfaces 2''' or valley surfaces 1", with the dimension in the longitudinal strip direction of the sets or groups of ridged retroreflective wedges being at least equal and preferably somewhat longer than that of the intermediate segments. Decreasing the number of normal wedges in each set or group provides more visual contrast from daylight or overhead ambient light at night between the marker and the road surface, but the apparent observed brightness of a continuous line by retroreflection from automobile headlamps at night is then diminished.

The dimensions of a preferred construction, as set forth in Table I, have been found to produce a visually effective roadway strip marker for any conditions of daylight and overhead ambient light at night as well as retroreflection by automobile headlamps under both wet and dry road conditions.

The visual appearance of a strip marker made in accordance with the specifications of Table I is that of a continuous line when viewed from a distance of greater than about 30 feet. At nearer distances, the appearance is still of a continuous line but interrupted with a pattern of ridges.

TABLE I

| | |
|---|---|
| Flat top surface length (2) for wedge T | 300 mils |
| Valley floor suface length (1'-V) | 300 mils |
| Wedge height h | 50–60 mils |
| Intermediate flat segment length 2''' or 1" | 4 inches |
| Number of wedges between intermediate segments 2''' or 1" | 10 |
| Angle $\alpha$ | 0–45 degrees |

The surface marking strip of the invention may be made by the following illustrative method. A section of a continuous flat rubber sheet such as described in said copending application Ser. No. 309,312, is coated with a glass bead bonding silane solution. Immediately thereafter, glass microspheres of 0.003" to 0.010" diameter are cascaded onto said silane coated areas where they are temporarily retained by the liquid coating. The excess beads are removed by blowing a stream of air across the sheet. The treatment of silane and glass beads is periodically repeated in a pattern corresponding to and in synchronism with the wedge pattern of an embossing drum. Prior to the embossing station, the sheeting with the silane and trapped glass beads is subjected to 250° F. heat for a short time partially to dry the silane and soften up the rubber sheeting in preparation for embossing the wedges into the surface of the sheeting. During the process of embossing, the surface of the rubber sheeting is deformed in the glass beaded area only, and the beads are partially pressed into the wedge tops and near vertical faces of the wedges and almost completely pressed into the valley floors. There are no beads in the flat sections. After embossing the wedge patterns, with the uncoated and unbeaded segments remaining flat, the sheeting is then subjected to further heat where the top portion of the sheeting is cured in order permanently to maintain the wedge pattern without destroying the conformability of the lower portion of the sheeting. A coating of silicone is then applied to the top embossed surface which serves the purpose of preventing the adhesive layer from sticking and blocking, as one layer is pressed against another in winding up the finished product. The silicone coating further prevents exposure of the glass bead surface to attack by noxious vapors in the atmosphere which might otherwise impair the optical properties of the glass beads. The layer of adhesive shown as 4 in FIGS. 1 and 2 is applied prior to winding up the sheeting.

The surface marker strip as made above, showed excellent visibility under all conditions of daylight even when the wedge section produced strong shadows such as viewing in the direction of the sun at a low angle. The retroreflection from the wedged section at night by automobile headlamp illumination was brilliant and even though the flat areas of diffuse reflection were dark they were not observed as dark regions at distances greater than about 30 feet.

Further modifications will suggest themselves in the light of the above to those skilled in the art, and such are considered to fall within the spirit and scope of the invention as defined in the appended claims.

What is claimed is:

1. A method of improving the daylight visibility of flexible plastic longitudinally extending roadway marker strips of rubber, rubber-like polyvinyl chloride, polyurethane, epoxy and similar sheet material, having successive sets of protuberances, ridges or ridge segments coated with projecting retroreflective beads that directionally reflect back incident headlight illumination directed along the market strip but that appear relatively dull in daylight and particularly at low angles of viewing; said method comprising coating with a glass bead bonding solution successive sets of segments of a top layer of a marker strip only where desired successive sets of protuberances, ridges or ridge segments are to be provided, while leaving intermediate top layer segments between such successive sets uncoded, the dimension of the intermediate segments in the longitudinal direction of the strip being about 10 to 40 times the corresponding dimension of the individual protuberances, ridges, or ridge segments in each set; applying retroreflective beads to said top layer of the strip; heating and deforming the coated successive segments of the strip into the desired successive sets of protuberances, ridges, or ridge segments, while maintaining the intermediate uncoated unbeaded segments flat; controlling said deforming to press the beads partially into the coated segments; cross-linking or vulcanizing said strip layer, simultaneously setting the coating and anchoring the beads on the successive deformed coated segments, and with the intermediate segments of the strip layer cross-linking or vulcanizing without attachment of any beads; the intermediate segments presenting a daylight-bright or colored appearance to the marker strip between duller sets of beaded retroreflective segments.

2. A method as claimed in claim 1 and in which the coating employs a silane adhesion promoter.

3. A method as claimed in claim 1 and in which the coating employs a vinyl-based polymer.

4. A method as claimed in claim 1 and in which the coating employs a polyurethane.

5. A method as claimed in claim 1 and in which the coating employs an epoxy.

6. A method as claimed in claim 1 and in which a silicone layer is applied to the strip to prevent sticking and blocking in rolling of one layer upon another and further to protect the glass beads from chemical attack under noxious vapors and the like.

7. A method as claimed in claim 1 and in which said method comprises first coating the strip with a pigmented polyurethane layer to produce diffuse light reflection.

8. A flexible longitudinally extending roadway marker strip of flexible plastic rubber-like sheet material comprising a cross-linked or vulcanized upper layer having longitudinally extending therealong successive sets of successively spaced protuberances, ridges or ridge segments deformed therein and extending transversely of the strip, each protuberance, ridge or ridge segment having at least forward and rearward surfaces to which projecting retroreflective bead coatings have been adhered, and flat unbeaded daylight-bright or colored-appearance segments disposed intermediate the successive sets and having a dimension in the longitudinal direction of the strip that is from about 10 to 40 times the corresponding dimension of the individual protuberances, ridges or ridge segments in each set and substantially equal to or less than that of the total protuberances, ridges or ridge segments and the spaces therebetween in each set.

9. A flexible roadway marker strip as claimed in claim 8 and in which a silicone layer is applied to the strip to prevent sticking and blocking in rolling one layer upon another and further to protect the glass beads from chemical attack under noxious vapors and the like.

10. A flexible roadway marker strip as claimed in claim 8 and in which the sheet material is selected from the group consisting of rubber, polyvinyl chloride, polyurethane and epoxy.

* * * * *